US008326190B2

(12) United States Patent
Hattori

(10) Patent No.: US 8,326,190 B2
(45) Date of Patent: Dec. 4, 2012

(54) SUBSTRATE CONFIGURATION FOR A DEVELOPER SUPPLY DEVICE

(75) Inventor: Tomoaki Hattori, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 218 days.

(21) Appl. No.: 12/729,441

(22) Filed: Mar. 23, 2010

(65) Prior Publication Data

US 2010/0247161 A1 Sep. 30, 2010

(30) Foreign Application Priority Data

Mar. 25, 2009 (JP) ..... 2009-074285

(51) Int. Cl.
*G03G 15/08* (2006.01)

(52) U.S. Cl. ..... 399/281

(58) Field of Classification Search ..... 399/281, 399/252, 266
See application file for complete search history.

(56) References Cited

U.S. PATENT DOCUMENTS

| | | | | |
|---|---|---|---|---|
| 3,662,884 | A | 5/1972 | Robinson | |
| 5,142,336 | A | 8/1992 | Hotomi et al. | |
| 6,272,296 | B1 | 8/2001 | Gartstein | |
| 6,941,098 | B2 | 9/2005 | Miyaguchi et al. | |
| 2003/0210928 | A1 | 11/2003 | Miyaguchi et al. | |
| 2005/0152717 | A1* | 7/2005 | Miyaguchi et al. | 399/252 |
| 2007/0212121 | A1 | 9/2007 | Takahashi et al. | |
| 2009/0214270 | A1* | 8/2009 | Kataoka et al. | 399/266 |
| 2009/0297228 | A1 | 12/2009 | Maeda et al. | |

FOREIGN PATENT DOCUMENTS

| | | | |
|---|---|---|---|
| JP | 51-2250 | | 1/1976 |
| JP | 51-2250 | A | 1/1976 |
| JP | 60-115962 | | 6/1985 |
| JP | 63-013069 | | 1/1988 |
| JP | 03-012678 | | 1/1991 |
| JP | 11-084862 | | 3/1999 |
| JP | 2001-209246 | | 8/2001 |
| JP | 2002-287495 | | 10/2002 |
| JP | 2002287495 | A * | 10/2002 |
| JP | 2003265982 | A | 9/2003 |
| JP | 2007-272195 | | 10/2007 |
| JP | 2009003212 | A | 1/2009 |
| WO | 2008066015 | A1 | 6/2008 |

OTHER PUBLICATIONS

Japanese Notice of Allowance for application No. 2009-074285 mailed Nov. 22, 2011.

* cited by examiner

*Primary Examiner* — Quana M Grainger
(74) *Attorney, Agent, or Firm* — Banner & Witcoff, Ltd.

(57) ABSTRACT

A developer supply device, comprising a casing having an opening facing a supply target and a developer reservoir portion provided on an opposite side; a roller-like developer holding body placed around the opening to face the supply target; a main carrying substrate that is located to face the developer holding body at a downstream end portion thereof in a developer transport direction and is configured to carry the developer through a traveling electric field to the developer holding body; and a sub carrying substrate that has a facing part to face the main carrying substrate, the sub carrying substrate being configured to carry the developer from the developer reservoir portion to the facing part through a traveling electric field, and wherein the sub carrying substrate carries the developer in the facing part in a direction opposite to a direction in which the main carrying substrate carries the developer.

8 Claims, 5 Drawing Sheets

N

SUBSTRATE CONFIGURATION FOR A DEVELOPER SUPPLY DEVICE

CROSS-REFERENCE TO RELATED APPLICATION

This application claims priority under 35 U.S.C. §119 from Japanese Patent Application No. 2009-074285, filed on Mar. 25, 2009. The entire subject matter of the application is incorporated herein by reference.

BACKGROUND

1. Technical Field

Aspects of the present invention relate to a developer supply device configured to supply a charged developer to a supply target.

2. Related Art

Developer supply devices configured to supply a charged developer to a supply target have been widely used. One of such developer supply devices is configured to have a plurality of carrying electrodes arranged along a developer transport direction so that the developer can be carried through an electric field generated by voltage application to the plurality of electrodes.

SUMMARY

It is understood that if a developer not properly charged (e.g., a non-charged developer, a low-charged developer, or an inversely charged developer) is supplied to the supply target, the quality of a formed image deteriorates.

Aspects of the present invention are advantageous in that a developer supply device configured to bring a supply state of a developer to a suitable state so that excellent image formation can be performed is provided.

According to an aspect of the invention, there is provided a developer supply device, comprising: a casing having an opening formed to face a supply target and a developer reservoir portion provided, on an opposite side with respect to the opening, to accommodate a developer; a developer holding body that is a roller-like member having a cylindrical circumferential surface and a rotation axis extending in a main scanning direction so that the developer holding body is rotated about the rotation axis, the developer holding body being placed around the opening to be accommodated in the casing and to face the supply target; a main carrying substrate that is located to face the developer holding body at a downstream end portion thereof in a developer transport direction and is configured to carry the developer through a traveling electric field to the developer holding body; and a sub carrying substrate that has a facing part where the sub carrying substrate faces the main carrying substrate, the sub carrying substrate being configured to carry the developer from the developer reservoir portion to the facing part through a traveling electric field so as to pass the developer to the main carrying substrate in the facing part. In this configuration, the sub carrying substrate carries the developer in the facing part in a direction opposite to a direction in which the main carrying substrate carries the developer.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
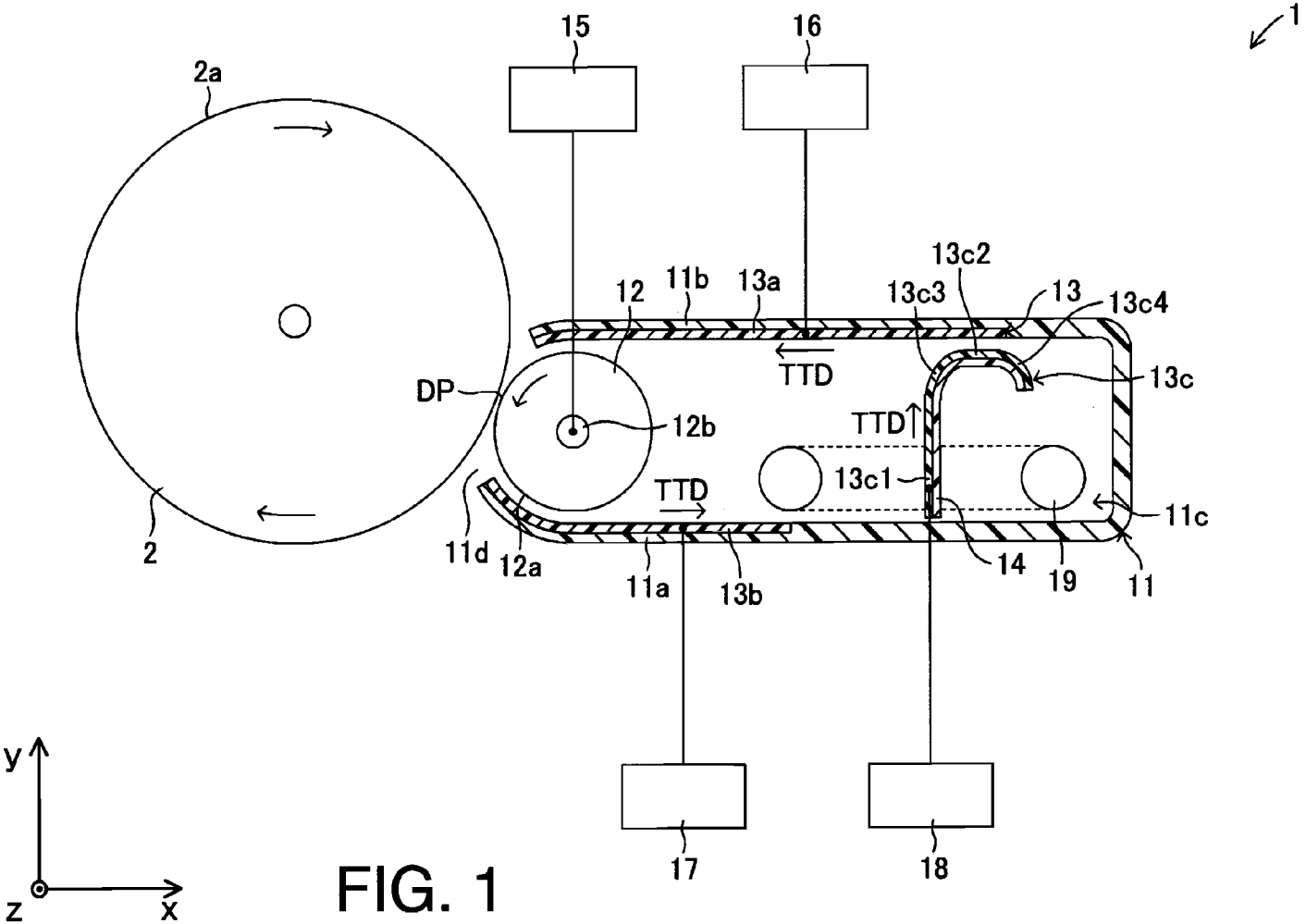
FIG. 1 is an enlarged side cross section illustrating a configuration of a toner supply device according to an embodiment.

As shown in FIG. 1, a toner supply device 1 according to the embodiment is configured to supply dry type toner (dry type developer), which is positively charged powdery toner, to a photosensitive drum 2 serving as a supply target. In this embodiment, the toner has a positive electrostatic property, and is single component black toner having a nonmagnetic property.

An electrostatic latent image holding surface 2*a* is formed on an outer circumferential surface of the photosensitive drum 2. The electrostatic latent image holding surface 2*a* is formed as a cylindrical surface provided to be parallel with a main scanning direction (i.e., z-axis direction in FIG. 1). As described later, an electrostatic latent image is formed on the electrostatic latent image holding surface 2*a* by potential distribution, and the toner is held at portions corresponding to the electrostatic latent image.

The photosensitive drum 2 has a center axis extending in the main scanning direction, and is configured to be rotated about the center axis in a rotational direction indicated by arrows in FIG. 1 (i.e., a clockwise direction in FIG. 1). That is, the electrostatic latent image holding surface 2*a* moves along an auxiliary scanning direction which is perpendicular to the main scanning direction.

The toner supply device 1 is located on a side of the photosensitive drum 2 to face the photosensitive drum 2. The toner supply device 1 is configured to supply, at a development position DP, the toner which is in a charged state. It should be noted that the development position DP is a position at which the toner supply device 1 faces the electrostatic latent image holding surface 2*a*.

When viewed as a side cross section, a casing 11 of the toner supply device 1 is formed as a box type member having a rectangular shape or an elliptic shape. The casing 11 is arranged such that the lengthwise direction thereof is parallel with a depth direction, i.e., a horizontal direction (x-axis direction). Each of a bottom plate 11*a* and a top plate 11*b* of the casing 11 is a thin plate-like member. The bottom plate 11*a* and the top plate 11*b* are arranged to face with each other in a vertical direction (y-axis direction).

When viewed as a side cross section, an end portion of the bottom plate 11*a*, which is located on a side close to the photosensitive drum 2 in the depth direction, is formed to have a circular arc curved obliquely in an upward direction. When viewed as a side cross section, an end portion of the top plate 11*b*, which is located in the depth direction on a side close to the photosensitive drum 2, is formed to have a circular arc curved obliquely in a downward direction.

The casing 11 is configured to store the toner in a toner reservoir 11*c* located at the bottom of the casing 11. When viewed as a side cross section, at an end portion which is located in the lengthwise direction and which faces the photosensitive drum 2, an opening 11*d* is formed.

In the inside of the casing 11, a development roller 12 (serving as a developer holding body) is accommodated. The development roller 12 is a roller-like member having a toner holding surface 12*a*, and is arranged to face the photosensitive drum 2 through the opening 11*d*. That is, the casing 11 and the development roller 12 are arranged such that the toner holding surface 12*a* of the development roller 12 is closely located at the development position DP with respect to the electrostatic latent image holding surface 2*a* via a certain interval of approximately 500 μm.

The development roller 12 is supported by the casing 11 to be rotatable. That is, the development roller 12 is rotated to rotate about a roller rotation shaft 12*b* which is parallel with the main scanning direction.

As shown in FIG. 1, a carrying substrate 13 (13*a*, 13*b*, 13*c*) is provided along a toner transport path TTP in the casing 11. The carrying substrate 13 is fixed to an inner wall of the casing 11. In this embodiment, the carrying substrate 13 includes a main carrying substrate 13*a*, a collecting carrying substrate 13*b* and a sub-carrying substrate 13*c* which are explained in detail later.

The main carrying substrate 13*a* is supported on the inner wall of the top plate 11*b* in the casing 11. The main carrying substrate 13*a* serves to carry the toner received from the sub-carrying substrate 13*c* to the development roller 12.

More specifically, the main carrying substrate 13*a* is arranged such that a downstream end thereof in a toner transport direction TTD reaches an edge of the opening 11*d*. Furthermore, the main carrying substrate 13*a* is arranged such that an upstream end thereof in the toner transport direction TTD faces the sub-carrying substrate 13*c*. That is, the size of the main carrying substrate 13*a* in the toner transport direction TTD is considerably larger than the size of the casing 11 in the vertical direction. More specifically, the size of the main carrying substrate 13*a* in the toner transport direction TTD is twice as large as the size of the casing 11 in the vertical direction.

In this embodiment, the main carrying substrate 13*a* is arranged such that the downstream end thereof in the toner transport direction TTD faces the development roller 12 to have a certain gap. More specifically, when viewed as a side cross section, the downstream end of the main carrying substrate 13*a* in the toner transport direction TTD is formed to be a circular arc whose shape is similar to the circular arc shape of the end of the top plate 11*b* of the casing 11 located on the side close to the photosensitive drum 2.

A portion of the main carrying substrate 13*a* other than the above described ends is formed to be a plate-like member which is parallel with the horizontal surface. That is, the portion of the main carrying substrate 13*a* other than the above described ends is configured to carry the toner in the horizontal direction.

The collecting carrying substrate 13*b* is supported on an inner wall of the bottom plate 11*a* in the casing 11. The collecting carrying substrate 13*b* collects the toner not consumed at the development position DP from the development roller 12, and circulates the collected toner to the toner reservoir 11*c*.

More specifically, the collecting carrying substrate 13*b* is arranged such that the upstream end in the toner transport direction TTD reaches an edge of the opening 11*d*. Further, the collecting carrying substrate 13*b* is arranged such that the downstream end in the toner transport direction TTD is situated at a position between the development roller 12 and the sub carrying substrate 13*c*.

In this embodiment, the collecting carrying substrate 13*b* is arranged such that the upstream end thereof faces the development roller 12 to have a certain gap with respect to the development roller 12. More specifically, when viewed as a side cross section, the upstream end of the collecting carrying substrate 13*b* in the toner transport direction TTD is formed to be a circular arc whose shape is similar to the circular arc shape of the end of the bottom plate 11*a* of the casing 11 located on the side close to the photosensitive drum 2.

The sub-carrying substrate 13*c* is curved to have a shape of an inversed letter "J", and is accommodated in the casing 11. More specifically, an upstream portion 13*c*1 of the sub-carrying substrate 13*c* in the toner transport direction TTD is arranged to stand to carry the toner in the vertical direction. A lower end of the upstream portion 13*c*1 is positioned in the toner reservoir 11*c*. In this embodiment, the upstream portion 13*c*1 of the sub-carrying substrate 13*c* has a size considerably smaller than the size of the main carrying substrate 13*a* in the toner transport direction TTD. More specifically, the size of the upstream portion 13*c*1 of the sub-carrying substrate 13*c* is smaller than or equal to ½ of the size of the main carrying substrate 13*a* in the toner transport direction TTD.

A downstream portion 13*c*2 of the sub-carrying substrate 13*c* in the toner transport direction TTD is arranged to face the main carrying substrate 13*a*. The downstream portion 13*c*2 is configured to carry the toner in a direction opposite to the direction in which the main carrying substrate 13*a* carries the toner.

A joint portion 13*c*3 of the upstream portion 13*c*1 and the downstream portion 13*c*2 is formed to be a curved surface. More specifically, the upstream portion 13*c*1 and the downstream portion 13*c*2 are smoothly connected via the joint portion 13*c*3 having the shape of the curved surface. Further, the joint portion 13*c*3 and the downstream portion 13*c*2 are formed to be curved in an inverse direction of the toner transport direction TTD defined on the main carrying substrate 13*a*.

A downstream end 13*c*4 of the sub-carrying substrate 13*c* in the toner transport direction TTD is curved downward in an oblique direction. That is, the downstream end 13*c*4 of the sub-carrying substrate 13*c* is formed to circulate the toner, which has not moved to the main carrying substrate 13*a*, to the deepest part of the ink reservoir 11*c* (i.e., the end of the ink reservoir 11*c* opposite to the side of the opening 11*d*).

The sub-carrying substrate 13*c* is supported by a sub-carrying substrate support body 14 accommodated in the casing 11. That is, the sub-carrying substrate support body 14 is a thin plate-like member having a shape of an inversed letter "J", and includes a plate-like vertical part extending in the vertical direction, a horizontal part (corresponding to the downstream portion 13*c*2 of the sub-carrying substrate 13*c*) which has a plate-like shape to be parallel with the top plate 11*b* and is located on a deeper side with respect to the plate-like vertical part (i.e., on the side opposite to the opening 11*d*), a curved surface part (corresponding to the joint portion 13*c*3 of the sub-carrying substrate 13*c*) smoothly connecting the plate-like vertical part and the horizontal part, and a downstream curved surface part (corresponding to the downstream end 13*c*4 of the sub-carrying substrate 13*c*) curved downward in an oblique direction from the deeper side end of the horizontal part.

The roller rotation shaft 12*b* of the development roller 12 is electrically connected to a development power circuit 15. The main carrying substrate 13*a* of the carrying substrate 13 is electrically connected to a main power circuit 16. The collecting carrying substrate 13*b* is electrically connected to a collection power circuit 17. The sub-carrying substrate 13*c* is electrically connected to a sub-carrying power circuit 18.

The development power circuit 15, the main power circuit 16, the collection power circuit 17 and the sub-carrying power circuit 18 output required voltages such that the toner stored in the toner reservoir 11*c* is carried by the sub-carrying substrate 13*c* to the upstream end in the toner transport direction TTD of the main carrying substrate 13*a*, and the toner which has passed from the sub-carrying substrate 13*c* to the upstream end of the main carrying substrate 13*a* is carried to the development roller 12 so that the toner is held on the toner holding surface 12*a* and then is supplied to the development position DP, and further the toner which has not been consumed at the development position DP is collected by the collecting carrying substrate 13*c* and is circulated to the toner reservoir 11*c*. In this embodiment, the output voltages of the development power circuit 15, the main power circuit 16, the collection power circuit 17 and the sub-carrying power circuit 18 are generated by combining a DC voltage with an AC voltage.

In the toner reservoir 11*c*, a toner transport auger 19 is provided to connect the deeper side with respect to the sub-carrying substrate 13*c* and the sub-carrying substrate support body 13 with the opening 11*d* side. The toner transport auger 19 serves to return the toner accumulated in the deepest portion of the toner reservoir 11*c* (i.e., the end of the reservoir opposite to the opening 11*s* side) to the position at which the toner is able to be carried upward by the sub-carrying power circuit 18.

It should be noted that each of the man carrying substrate 13*a*, the collecting carrying substrate 13*b* and the sub-carrying substrate 13*c* has a width corresponding to a scanning width in the main scanning direction. For example, the toner transport auger 19 has a shaft and a spiral coil provided in the shaft. The toner transport auger 19 is arranged not to interfere the sub-carrying substrate 13*c*.

Figure 2:
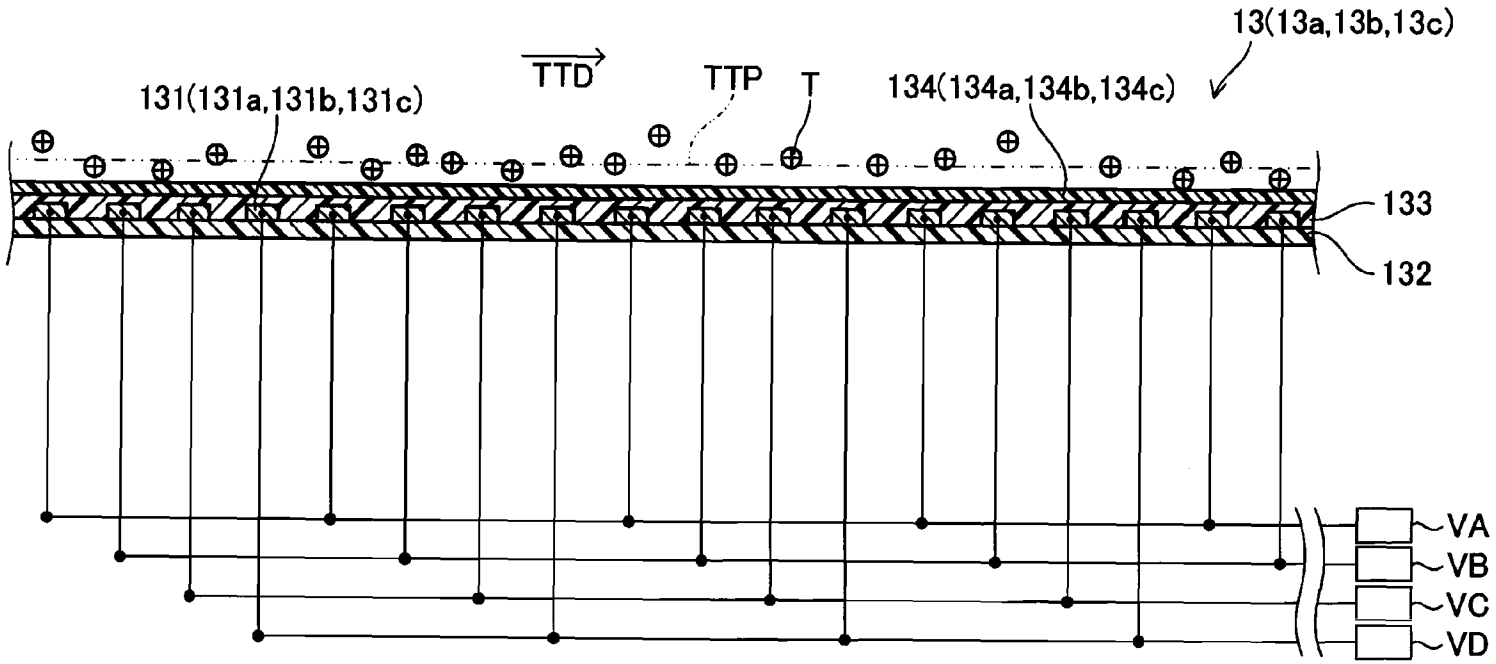
FIG. 2 is a partial side cross section of a carrying substrate provided in the toner supply device.

As shown in FIG. 2, the carrying substrate 13 is a thin plate-like member, and has a structure substantially equal to a general structure of a flexible printed circuit. More specifically, the carrying substrate 13 includes carrying electrodes 131, an electrode support film 132, an electrode coating 133 and an electrode overcoating 134. Each of the carrying electrodes 131 is a linear pattern having a longer side parallel with the main scanning direction, and is formed of copper foil having a thickness of several μm. That is, each of the carrying electrodes 131 is formed to be perpendicular to the auxiliary scanning direction. The plurality of carrying electrodes are arranged along the toner transport path TTP to be parallel with each other.

As shown in FIG. 2, the plurality of carrying electrodes 131 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD—are repeatedly arranged in this order along the toner transport path TTP. It should be noted that the power supply circuits VA, VB, VC and VD are provided in each of the main power circuit 16, the collection power circuit 17 and the sub-carrying power circuit 18.

Figure 3:
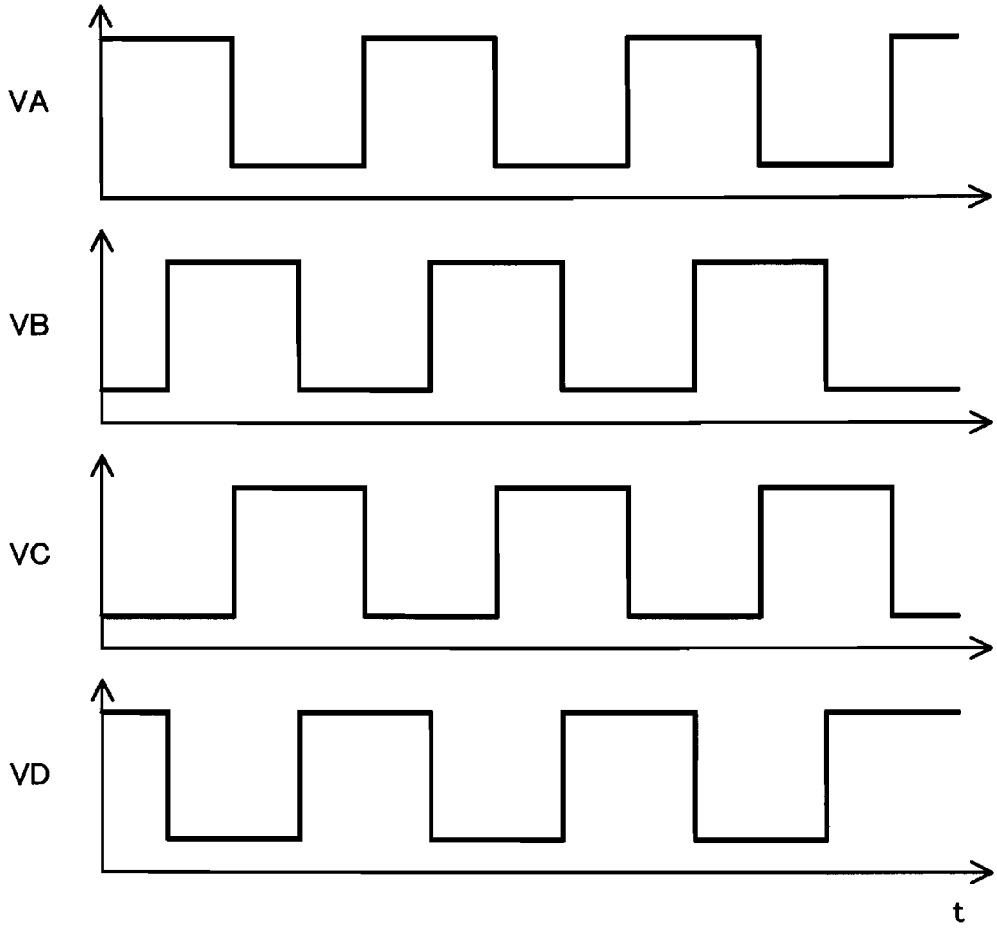
FIG. 3 is a timing chart illustrating waveforms of output signals of power supply circuits.

As shown in FIG. 3, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 131, the carrying substrate 13 generates a traveling electric field along the toner transport path TTP so that the positively charged toner is carried in the toner transport direction TTD.

The plurality of carrying electrodes 131 are formed on the electrode support film 132. The electrode support film 132 is an elastic film, for example, made of insulating synthetic resin such as polyimide resin.

The electrode coating 133 is made of insulating synthetic resin. The electrode coating 133 is provided to cover the carrying electrodes 131 and a surface of the electrode support film 132 on which the carrying electrodes 131 are formed.

On the electrode coating 133, the electrode overcoating 134 is formed. Hereafter, the electrode overcoating 134 formed on the main carrying substrate 13*a*, the electrode overcoating 134 formed on the collecting carrying substrate 13*b* and the electrode overcoating 134 formed on the sub-carrying substrate 13*c* are referred to as a main electrode overcoating 134*a*, a collecting electrode overcoating 134*b* and a sub-carrying electrode overcoating 134*c*, respectively. That is, the electrode coating 133 is formed between the electrode overcoating 134 and the carrying electrodes 131. A surface of the electrode overcoating 134 is formed to be a smooth flat surface without bumps and dips so that the toner can be carried smoothly.

In this embodiment, the main electrode overcoating 134*a* and the collecting electrode overcoating 134*c* are made of the same material (e.g., polyester). That is, as the material of the main electrode overcoating 134*a* and the collecting electrode overcoating 134*b*, material which is a trbicharging material for properly charging the toner and has a triboelectrification position on the plus side in the triboelectrification order with respect to the material of the sub-carrying electrode overcoating 134*c* is adopted. That is, the material of the main electrode overcoating 134*a* and the collecting electrode overcoating 134*c* has the same electrification polarity as that of the material of the toner with respect to the material of the sub-carrying electrode overcoating 134*c*.

Hereafter, operations of the toner supply device 1 are explained.

As shown in FIG. 1, with regard to the toner stored in the toner reservoir 11*c* of the casing 1, a part of the toner contacting the lower end of the upstream portion 13*c*1 of the sub-carrying substrate 13*c* is carried upwardly in the vertical direction through the traveling electric field generated by applying the voltage to the sub-carrying substrate 13*c*. When the toner is carried upwardly in the vertical direction along the upstream portion 13*c*1 of the sub-carrying substrate 13*c*, the toner not properly charged departs from the toner transport path TTP around the upstream portion 13*c*1, and falls downwardly.

The toner which has carried upward by the upstream portion 13*c*1 of the sub-carrying substrate 13*c* reaches the position where the downstream portion 13*c*2 of the sub-carrying substrate 13*c* and the upstream end of the upstream side of the main carrying substrate 13*a* in the toner transport direction TTD face with each other. At this position, the direction in which the toner is carried by the downstream portion 13*c*2 of the sub-carrying substrate 13*c* and the direction in which the toner is carried by the main carrying substrate 13*a* are opposite to each other. Therefore, at this position, only the properly charged toner is selectively carried by the main carrying substrate 13*a* toward the development roller 12.

That is, in this embodiment, through carrying of the toner in the vertically upward direction by the upstream portion 13*c*1 of the sub-carrying substrate 13*c* and through carrying of the toner by the upstream end of the main carrying substrate 13*a* in the direction opposite to the direction in which the toner is carried by the downstream portion 13*c*2 of the sub-carrying substrate 13*c*, the toner properly charged and the toner not properly charged are suitably separated.

In this embodiment, the main electrode overcoating 134*a* has the functionality of further positively charging the positively charged toner weaker than that of the sub-carrying electrode overcoating 134*c* of the sub-carrying substrate 13*c*. Such a configuration makes it possible to prevent changing of the charged state of the toner being carried by the main carrying substrate 13*a* to the development roller 12 for a relatively long distance.

At the position where the downstream end in the toner transport direction TTD of the main carrying substrate 13*a* and the development roller 12 face with each other, the toner is held on the toner holding surface 12*a*. Then, by rotations of the development roller 12 in the direction indicated by arrows in FIG. 1, the positively charged toner is supplied to the development position DP. Around the development position DP, the electrostatic latent image formed on the electrostatic latent image holding surface 2*a* is developed by the toner. That is, the toner adheres to portions where the positive charges are removed from the electrostatic latent image holding surface 2*a*. Thus, an image formed by the toner (hereafter, referred to as a toner image) is held on the electrostatic latent image holding surface 2*a*.

The toner which has passed through the development position DP while being held on the toner holding surface 12*a* moves to the side of the collecting carrying substrate 13*c*. That is, the toner is collected by the collecting carrying substrate 13*b* from the toner holding surface 12*a*.

If a collecting bias having an alternating component is applied to the development roller 12, the toner adjacent to the toner holding surface 12*a* of the development roller 12 vibrates by the effect of the alternating component of the collecting bias. Through such vibrations, the toner being lifted from the toner holding surface 12*a* collides with the toner adhered to the toner holding surface 12*a*. Through such a collision of the toner, the toner held on the toner holding surface 12*a* tends to be easily lifted from the toner holding surface 12*a*.

Through the effect of the collecting bias, the toner which has not consumed at the development position DP on the toner holding surface 12*a* is suitably removed, and moves to the collecting carrying substrate 13*b*. Such a configuration makes it possible to prevent a ghost from appearing on the formed image.

Furthermore, the collecting bias also serves as a bias for a jumping phenomenon at the development position DP. Consequently, it becomes possible to achieve the collecting bias with a simple structure.

The toner which has moved to the collecting carrying substrate 13*b* from the toner holding surface 12*a* is circulated to the toner reservoir 11*c* through the electric field generated by applying the voltage to the collecting carrying substrate 13*b*.

Hereafter, advantages achieved by the embodiment are described.

In the above described embodiment, the toner is carried upwardly in a vertical direction along the upstream portion 13*c*1 of the sub-carrying substrate 13*c*, and is carried by the upstream end in the toner transport direction TTD of the main carrying substrate 13*a* in the direction opposite to the direction in which the toner is carried by the downstream portion 13*c*2 of the sub-carrying substrate 13*c*.

With this configuration, the toner properly charged and the not properly charged can be suitably separated with respect to each other. Further, the toner properly charged is selectively passed from the sub-carrying substrate 13*c* to the main carrying substrate 13*a*, and is carried to the development roller 12. Furthermore, the toner is held on the toner holding surface 12*a* to be supplied to the development position DP.

That is, according to the embodiment, it is possible to supply the toner properly charged to the development position DP. Therefore, according to the embodiment, it is possible to properly supply the toner to the photosensitive drum 2. Consequently, it is possible to execute appropriately the image formation.

In the above described embodiment, the size of the main carrying substrate 12*a* in the toner transport direction TTD is sufficiently larger than the size of the upstream portion 13*c*1 of the sub-carrying substrate 13*c*. Therefore, the carrying distance of the toner in the horizontal direction by the main carrying substrate 13*a* is sufficiently longer than the carrying direction of the toner in the vertically upward direction by the upstream portion 13*c*1 of the sub-carrying substrate 13*c*.

Accordingly, it becomes possible to decrease the thickness of the toner supply device 1 (i.e., to downsize the toner supply device 1 in the vertical direction) while achieving the above described advantages.

Although the present invention has been described in considerable detail with reference to certain preferred embodiments thereof, other embodiments are possible.

Hereafter, variations of the toner supply device are explained. It should be noted that, in the following, to elements which are substantially the same as those of the above described embodiment, the same reference numbers are assigned, and explanations thereof will not be repeated.

(1) The toner supply device 1 may be applied to various types of electrophotographic image forming devices, such as a monochrome laser printer, a color laser printer, a monochrome copying device, and a color copying device. In regard to the types of a photosensitive body provided in an image forming device to which the toner supply device is applied, it is understood that the photosensitive body can take various types of shapes. That is, the shape of the photosensitive body is not limited to the drum-like shape. For example, the photosensitive body may be formed to be a plate-like shape or an endless belt.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(2) The development roller 12 may contact the photosensitive drum 2.

(3) The plate-like part of each of the main carrying substrate 13*a* or the collecting carrying substrate 13*b* may be inclined to some extent with respect to the horizontal direction. Similarly, the upstream portion 13*c*1 of the sub-carrying substrate 13*c* may be formed to stand in the substantially vertical direction. That is, the upstream portion 13*c*1 may be inclined to some extent with respect to the vertical direction. The sub-carrying substrate 13*c* may be formed to have a shape of an inversed letter "U". In other words, the downstream end 13*c*4 of the sub-carrying substrate 13*c* may be formed to reach the toner reservoir 11*c*.

(4) The internal structure of the carrying substrate 13 is not limited to that shown in the above described embodiment. For example, the electrode overcoating 134 may be omitted. In this case, the material of the electrode coating 133 may be selected as in the case of the electrode overcoating 134. Alternatively, by burying the carrying electrodes 131 in the electrode support film 132, the electrode coating 133 and the electrode overcoating 134 can be omitted.

(5) The waveforms of the output voltages of the power supply circuits VA to VD are not limited to the rectangular shape shown in FIG. 3. For example, sine waveforms or triangular waveforms may be employed as output voltages of the power supply circuits VA to VD.

In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

Figure 4:
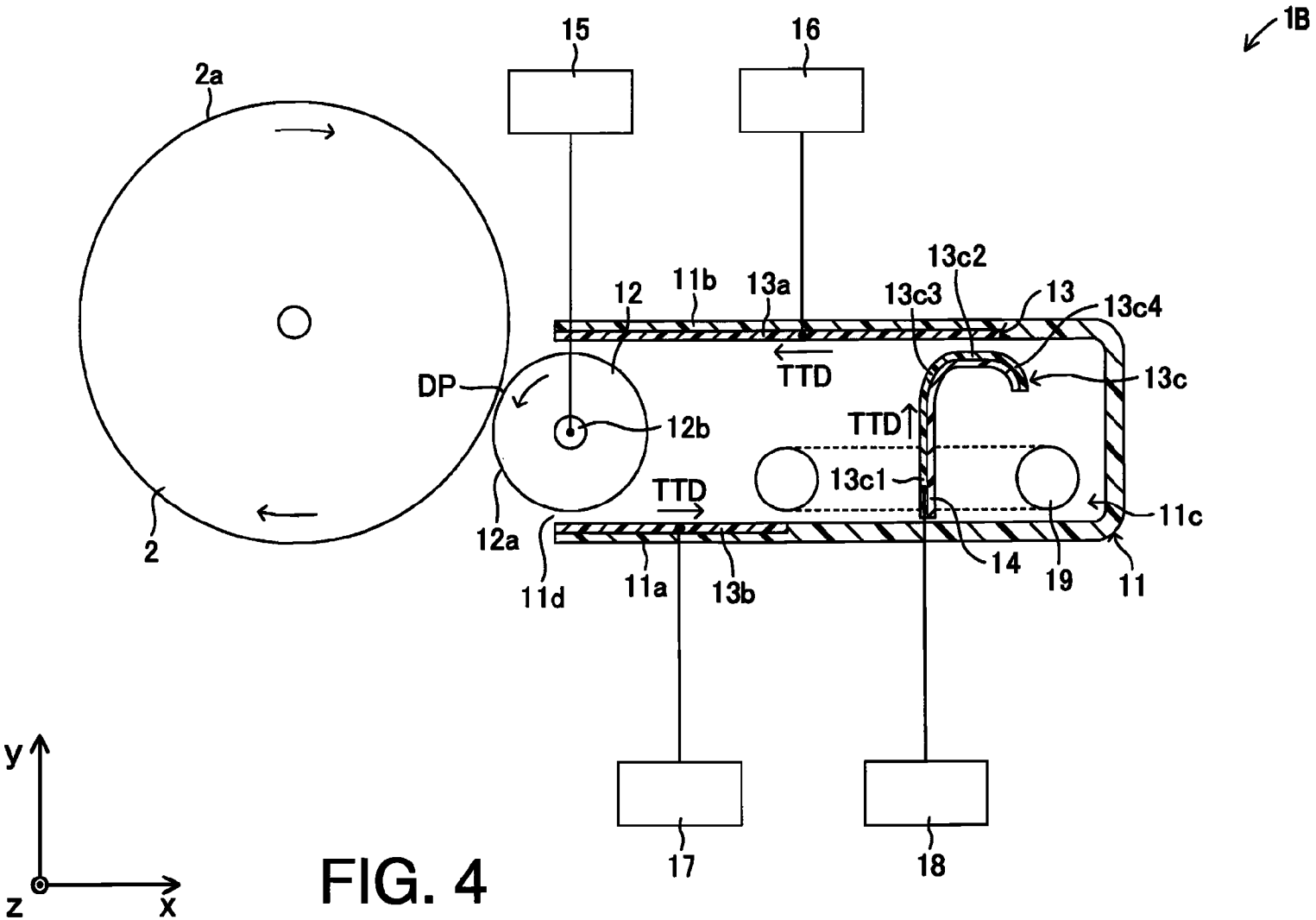
FIG. 4 is a side cross section illustrating a general configuration of a first variation of the toner supply device.

(6) As shown in FIG. 4, a toner supply device 1B (i.e., a first variation of the toner supply device 1) is configured such that each of the main carrying substrate 13*a* and the collecting carrying substrate 13*b* is formed to be a plate-like member not having a circular arc part when viewed as a side cross section. As shown in FIG. 4, the development roller 12 is provided in the casing 11 such that an approximately half of the toner holding surface 12*a* is exposed to the outside of the casing 11.

Figure 5:
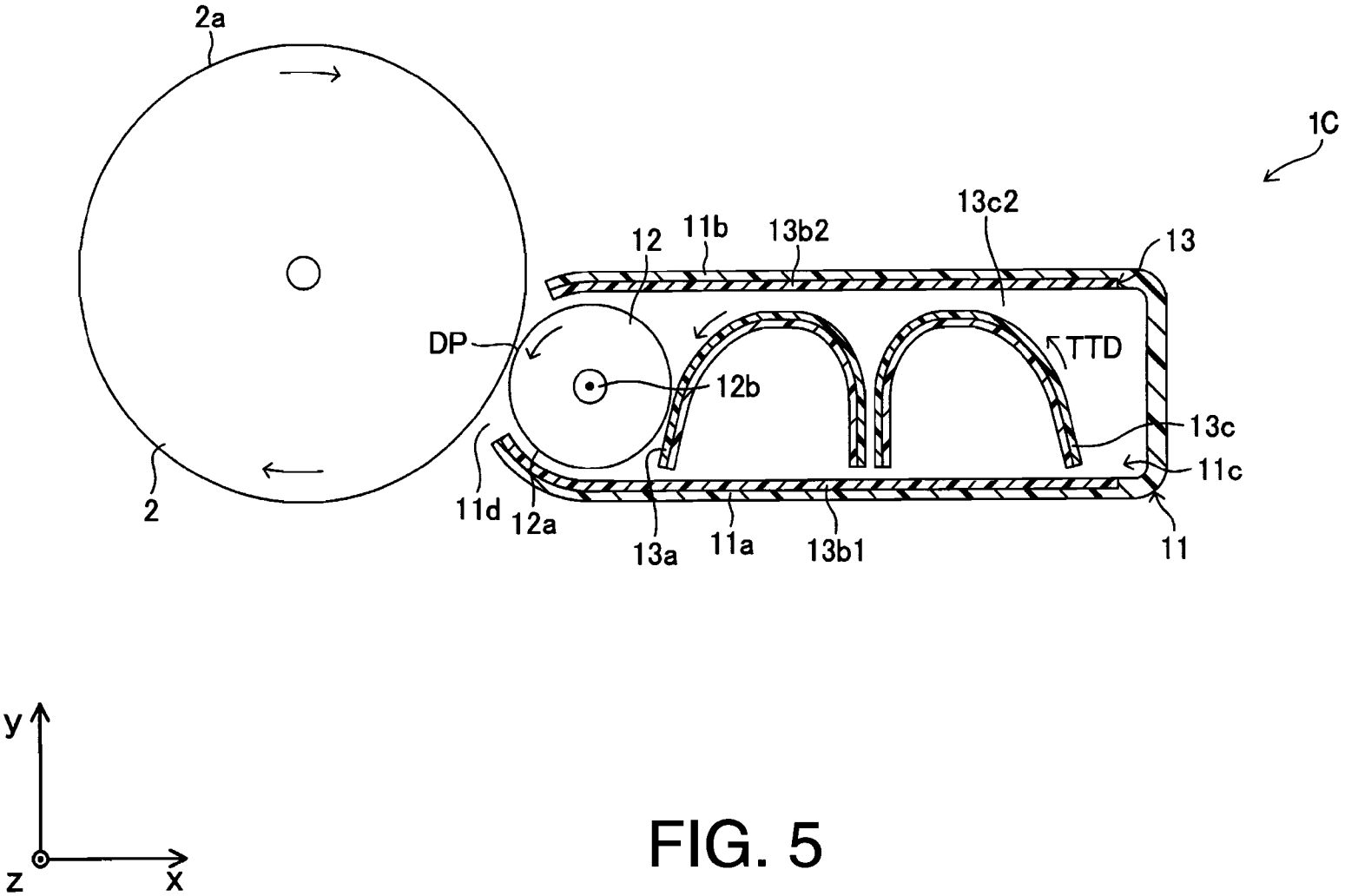
FIG. 5 is a side cross section illustrating a general configuration of a second variation of the toner supply device.

(7) As shown in FIG. 5, a toner supply device 1C (i.e., a second variation of the toner supply device 1) is configured such that the main carrying substrate 13*a* is accommodated in the casing 11 in a shape of an inversed letter "J" or "U", but is not supported on the bottom plate 11*a* or the top plate 11*b*.

In this case, the upstream end of the main carrying substrate 13*a* in the toner transport direction TTD and the downstream end of the sub-carrying substrate 13*c* in the toner transport direction TTD are provided to stand to be parallel with each other, and are positioned to face with each other via a certain gap.

Furthermore, in this case, a collecting carrying substrate 13*b*1 may be provided on the bottom plate 11*a*. Furthermore, a collecting carrying substrate 13*b*2 may be provided on the top plate 11*b* of the casing 11.

It is understood that the same advantages as those of the above described embodiment can be achieved by the variations.

It should be noted that, in the configuration shown in FIG. 5, the collecting carrying substrate 13*b*1 and/or the collecting carrying substrate 13*b*2 may be omitted.

What is claimed is:

1. A developer supply device, comprising:

a casing having an opening formed to face a supply target and a developer reservoir portion, provided on an opposite side with respect to the opening, to accommodate developer;

a developer holding body that is a roller-like member having a cylindrical circumferential surface and a rotation axis extending in a main scanning direction so that the developer holding body is rotatable about the rotation axis, the developer holding body being placed around the opening to be accommodated in the casing and to face the supply target;

a main carrying substrate positioned to face the developer holding body at a downstream end portion of the main carrying substrate in a developer transport direction and configured to carry the developer through a traveling electric field to the developer holding body; and a sub carrying substrate having a facing part where the sub carrying substrate faces the main carrying substrate, the sub carrying substrate being configured to carry the developer from the developer reservoir portion to the facing part through a traveling electric field generated, at least in part, by a portion of the sub carrying substrate, wherein the sub carrying substrate is further configured to pass the developer to the main carrying substrate through a space between the facing part of the sub carrying substrate and an upstream end portion of the main carrying substrate in the developer transport direction, wherein the sub carrying substrate carries the developer at the facing part in a direction opposite to a direction in which the main carrying substrate carries the developer, and wherein the sub carrying substrate is physically separate from the main carrying substrate.

2. The developer supply device according to claim 1, wherein the facing part of the sub carrying substrate is formed at a downstream end portion of the sub carrying substrate in the developer transport direction.

3. The developer supply device according to claim 1, wherein the main carrying substrate is formed to face the sub carrying substrate at the upstream end portion of the main carrying substrate in the developer transport direction.

4. The developer supply device according to claim 1, wherein:

the main carrying substrate is configured to carry the developer in a horizontal direction; and the sub carrying substrate is formed to carry the developer upwardly from the developer reservoir portion along a part of the sub carrying substrate located on an upstream side with respect to the facing part.

5. The developer supply device according to claim 4, wherein the sub carrying substrate is accommodated in the casing to have a form of an inversed letter "J".

6. The developer supply device according to claim 1, wherein:

each of the main carrying substrate and the sub carrying substrate is accommodated in the casing to have a form of an inversed letter "U";

the facing part of the sub carrying substrate is formed at a downstream end portion of the sub carrying substrate in the developer transport direction; and the main carrying substrate is formed to face the sub carrying substrate at the upstream end portion of the main carrying substrate in the developer transport direction.

7. The developer supply device according to claim 1, wherein the casing has, on a side of the opening, an end curved to face the developer holding body.

8. A developer supply device, comprising:

a casing having an opening formed to face a supply target and a developer reservoir portion, provided on an opposite side with respect to the opening, to accommodate developer;

a developer holding body that is a roller-like member having a cylindrical circumferential surface and a rotation axis extending in a main scanning direction so that the developer holding body is rotatable about the rotation axis, the developer holding body being placed around the opening to be accommodated in the casing and to face the supply target;

a main carrying substrate positioned to face the developer holding body at a downstream end portion of the main carrying substrate in a developer transport direction and configured to carry the developer through a traveling electric field to the developer holding body; and a sub carrying substrate having a facing part where the sub carrying substrate faces the main carrying substrate, the sub carrying substrate being configured to carry the developer from the developer reservoir portion to the facing part through a traveling electric field so as to pass the developer to the main carrying substrate in the facing part, wherein the sub carrying substrate carries the developer at the facing part in a direction opposite to a direction in which the main carrying substrate carries the developer, wherein each of the main carrying substrate and the sub carrying substrate is accommodated in the casing to have a form of an inversed letter "U", wherein the facing part of the sub carrying substrate is formed at a downstream end portion thereof in the developer transport direction, and wherein the main carrying substrate is formed to face the sub carrying substrate at an upstream end portion of the main carrying substrate in the developer transport direction.

* * * * *